United States Patent [19]

Ozaki

[11] 4,126,146

[45] Nov. 21, 1978

[54] COIN DELIVERING DEVICE OF COIN PROCESSING MACHINE

[75] Inventor: Ichiro Ozaki, Himeji, Japan

[73] Assignee: Glory Kogyo Kabushiki Kaisha, Japan

[21] Appl. No.: 732,616

[22] Filed: Oct. 15, 1976

[30] Foreign Application Priority Data

Oct. 17, 1975 [JP] Japan ..... 50-141615[U]
Jul. 10, 1976 [JP] Japan ..... 51-92238[U]

[51] Int. Cl.[2] ..... G07D 3/00
[52] U.S. Cl. ..... 133/3 A
[58] Field of Search ..... 133/1 R, 3 R, 3 A, 3 H, 133/8 R, 8 C; 198/862, 863; 221/159-162

[56] References Cited

U.S. PATENT DOCUMENTS 2,675,008 4/1954 Buchholz et al. ..... 133/8 R
3,795,253 3/1974 Hatanaka et al. ..... 133/3 A

*Primary Examiner*—Robert B. Reeves
*Assistant Examiner*—H. Grant Skaggs
*Attorney, Agent, or Firm*—Beveridge, DeGrandi, Kline & Lunsford

[57] ABSTRACT

A coin delivering device of a coin processing machine comprises a turntable supported on a base, a structure defining a coin passage having an inlet part which communicates with the turntable to deliver coins to be processed, an opening and closing frame pivotally supported on the base, a member for setting the upper limit of the thickness of the coins, and a coin propelling member disposed above the coin passage. The member for setting the upper limit of the thickness of the coins and the coin propelling member are separated together with the frame the turntable and the coin passage by rotating the frame, whereby a part in which coins are jammed can be easily found and the coins can be easily removed from the part.

8 Claims, 3 Drawing Figures

COIN DELIVERING DEVICE OF COIN PROCESSING MACHINE

BACKGROUND OF THE INVENTION

This invention relates to improvements in coin delivering devices of coin processing machines such as a coin wrapping machine or a coin counting machine.

Generally, a coin delivering device of a coin processing machine comprises a turntable for arranging coins to be processed in order by the centrifugal force caused by the rotation of the turntable, and a thickness limit setting member positioned above the upper surface of the periphery of the turntable with a space therebetween to pass only coins of thicknesses less than a predetermined thickness for processing, and a discharge outlet is formed on the peripheral wall of the turntable. This outlet communicates with the inlet of a coin passage having side walls which are variable with the width therebetween so as to pass only coins of diameters less than a predetermined width, and above this coin passage there is disposed coin propelling means such as an endless driving belt.

In a conventional coin delivering apparatus, a thickness limit setting member, side walls of a coin passage, and a coin delivering means are so adapted that they may be independently opened or separated from the turntable or the coin passage. In the case when coins are jammed between the thickness limit setting member and the turntable, between the side walls of the coin passage, or between the coin delivering means and the coin passage, the work of finding the part in which the coins are thus jammed and removing them by opening because of the movable members has been a troublesome complex structure of the device. In actual practice the coin removal operation has been done by opening all movable members, i.e., the thickness limit setting member, the side walls and the coin delivering means, regardless of whether or not the coins are jammed against these parts. Such an operation has been very laborious and much time has been required to remove the coins and to inspect and adjust the device. Furthermore, in a conventional device, the height adjustment of the thickness limit setting member has been achieved by means including a stationary plate disposed close to the peripheral edge of the turntable and a pair of pins embedded in the plate, the thickness limit setting member being caused to slide along these pins for adjustment. However, such a structure involves a problem in that the movement of the thickness limit setting member cannot be made smooth because of difficulty in precise adjustment of the parallel relationship between the paired pins.

SUMMARY OF THE INVENTION

An object of this invention is to provide an improved coin delivering device of a coin processing machine which has a mechanism for facilitating the determination of the part in which coins are jammed and the taking out of the coins.

Another object of the invention is to provide an improved mechanism for transmitting a driving power from a motor to coin delivering means to prevent an inordinate load from being exerted on the transmitting mechanism at the opening and the closing of a cover.

A further object of the invention is to provide an improved member for setting the upper limit of the thickness of coins to be processed which achieves easy and accurate adjustment of the height of the member.

According to this invention, briefly summarized, there is provided a coin delivering device of a coin processing machine comprising a base, a turntable supported on said base and adapted to move coins to be processed towards the periphery of the turntable by centrifugal force, structure defining a coin passage communicating with said turntable to deliver the coins in order, an opening and closing frame pivotally supported on the base, a member for setting the upper limit of the thickness of the coins to be passed, and coin propelling means disposed above said coin passage and operating to propel the coins along the coin passage, said member for setting the upper limit of the thickness of the coins and said coin propelling means being separable together with said frame from said turntable and said coin passage by rotating said frame.

The nature, utility and further objects of the invention will be apparent from the following detailed description with respect to preferred embodiments of the invention when read in conjunction with the accompanying drawings briefly described hereinbelow.

DETAILED DESCRIPTION

Figures 1, 2:
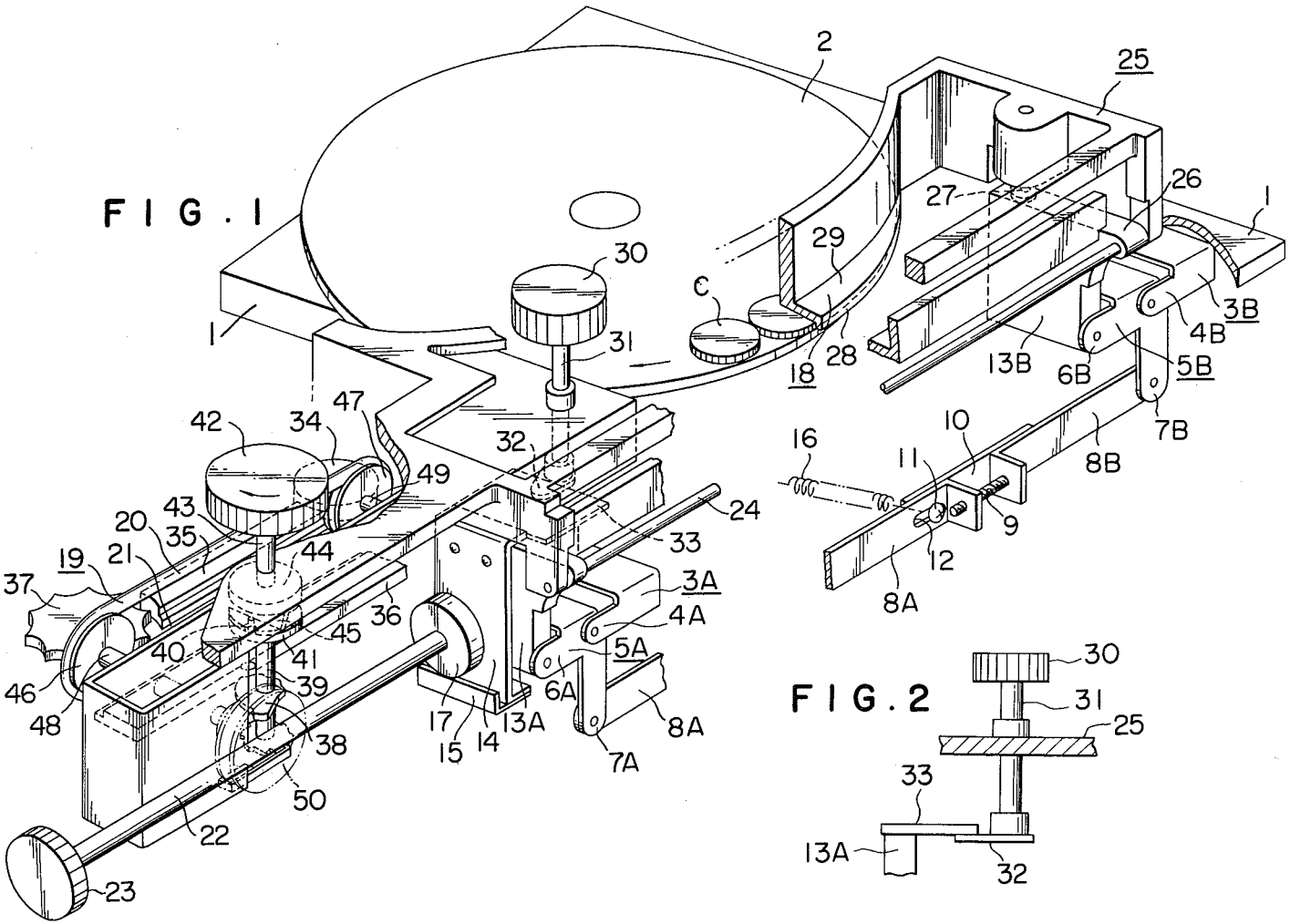
FIG. 1 is a perspective view showing the essential parts of one example of the coin delivering apparatus of a coin processing machine according to this invention.
FIG. 2 is an elevation showing a lock knob mechanism attached to a cover and used for opening and closing the cover.

Referring to FIG. 1, a convex turntable 2 is mounted on a base 1 of a coin processing machine in a manner to be rotatable by a motor (not shown). On the base 1 there are secured a pair of spaced frames 3A and 3B having respectively pivotally supporting arms 4A and 4B which project in the same direction. On these arms 4A and 4B of the frames 3A and 3B are pivotally provided raising and lowering links 5A and 5B having laterally projecting arms 6A and 6B and downwardly projecting arms 7A and 7B, respectively, which are pivotally supported by the links. Links 8A and 8B are pivotally supported on the downwardly projecting arms 7A and 7B.

The combined length of these links 8A and 8B is slightly less than the distance between the pivotally supporting arms 7A and 7B, and this combined length can be adjusted by rotating an adjusting screw 9 which is screwed into facing end flanges of the links 8A and 8B. On the end of the link 8B, a guide plate 10 is provided projectingly towards the other link 8A, and the guide plate 10 is provided with a pin 11 which is slidably engageable with a slot 12 provided in the link 8A to serve as a guide for adjusting the combined length of the links 8A and 8B.

Support structures 13A and 13B are pivotally provided on the laterally projecting arms 6A and 6B of the links 5A and 5B, respectively. These support structures 13A and 13B are constructed to be raised and lowered by guides which are not shown in FIG. 1. The support structure 13A is provided projectingly with a cam follower plate 14 having a cam follower 15, which cam follower plate 14 may be formed integrally with the support structure 13A.

To the pin 11, one end of a tension spring 16 is attached, and the other end of this spring is attached to a part (not shown) of the base 1. The spring 16 urges the links 8A and 8B upwardly. Accordingly, the support structures 13A and 13B, which are rockable together through the links 8A and 8B about fulcrums which are the supporting arms 4A and 4B of the frames 3A and 3B, are also urged upwardly, whereby the cam follower plate 14 integral with the support structure 13A is urged upwardly and forced into contact with a disc cam 17 abutted against the cam follower plate 14. This disc cam 17 serves to adjust, in accordance with the thickness of a coin to be processed, the distances between a thickness limit member 18 and the turntable 2 and between the coin propelling belt 20 of a coin propelling device or coin delivering means and a coin passage 21. The cam disc 17 is further connected to a thickness setting knob 23 through a support shaft 22 rotatably supported by a part (not shown in FIG. 1) of the base 1 to be rotated by rotational manipulation of the knob 23.

Between the support structures 13A and 13B is attached a horizontally extending rotatable shaft 24 on which a cover 25 is pivotally mounted. This cover 25 has a projection 27 which abuts against the upper surface 26 of the support structure 13B so that the upper surface of the cover 25 will be substantially horizontal when the cover 25 is closed, and the projection 27 thereof is abutted against the structure 13B. A stop (not shown) is further disposed on the base 1 to prevent the cover 25 from opening to an angle exceeding 90°. The cover 25 is also restricted and held by restricting means (not shown) at the full opening position.

The thickness limit member 18 provided integrally with the cover 25 and facing the periphery of the turntable 2 comprises a vertical edge part 28 along the outer peripheral edge of the turntable 2 and close thereto with small distance therebetween and a thickness limiting part 29 formed contiguous with the upper end of the vertical edge part 28 and facing the peripheral upper surface of the turntable 2. This thickness limiting part 29 is spaced apart from the turntable 2 by a distance such that a coin having a thickness less than a prescribed thickness will be passed therebetween when the cover 25 is closed. This distance can be adjusted by the rotation of the disc cam 17.

A lock shaft 31 having a lock knob 30 on the upper end thereof is screwed through the upper surface of the cover 25 so as to extend downward, as shown in FIG. 2. To the lower end of this lock shaft 31 is secured a perpendicularly projecting lug 32 which slidably contacts the lower surface of an engagement piece 33 projecting laterally from the support structure 13A to prevent the cover 25 from being opened inadvertently.

The coin inlet part of the coin passage 21 is contiguous to the downstream end of the thickness limiting member 18, and near this coin inlet part, there is provided a guide roller 34 which serves to guide coins C fed successively along the vertical end part 28 of the thickness limiting member 18 and to facilitate their entry into the coin passage 21.

The coin passage 21 is formed by the stepped portion of a fixed side wall 35 adjacent the guide roller 34 and the stepped portion of a movable side wall 36 which is parallel to the fixed side wall 35 and movable toward and apart from the side wall 35 and which has a guide member (not shown), both stepped portions being opposed to each other to deliver coins along the passage.

Above the coin passage 21, there is disposed the coin propelling belt 20 which moves and arranges the coins C delivered from the periphery of the turntable 2 towards the outlet part of the coin passage 21 during travel through the passage. A counting mechanism including a star-wheel 37 rotatable by the passing of the coins is disposed on one side of the coin propelling belt 20.

The movable side wall 36 of the passage 21 is provided with a contact part comprising a roller against which the peripheral surface of a cam 38 for setting the coin passage width is forced by the action of a spring (not shown). The upper end of a cam shaft 39 fixedly supporting the cam 38 is spaced from the cover 25 in the closed position thereof and is provided with a clutch plate 41 having an embedded pin 40.

A shaft 43, for setting a selected kind of coin and having a setting knob 42 projecting upwardly, is held rotatably by the cover 25. To the lower end of the shaft 43 opposite the clutch plate 41, another clutch plate 44 is fixed.

This clutch plate 44 includes an elastic clutch member 45 of leaf-spring form having a cutout which is engageable with the pin 40 of the clutch plate 41, and which can be engaged with the pin 40 when the cover 25 is closed, the cam 38 being caused to follow by rotating the setting knob 42. It should be noted that, since the setting shaft 43 is thus connected to the cam shaft 39 through the clutch plates 44 and 41, when the cover 25 is opened, the setting shaft 43 is opened together therewith, but the cam shaft 39 remains in its position.

Pulleys 46 and 47 around which the endless belt 20 is stretched to be driven thereby are respectively supported by supporting shafts 48 and 49 rotatably supported by the cover 25. Of these pulleys 46 and 47, the pulley 46 is the belt driving pulley, and its shaft 48 extends to the other side of the cover 25, where the end of this shaft 48 fixedly supports a driving pulley 50. Around this pulley 50, shown by two-dot chain line in FIG. 1, and a pulley fixed to the output shaft of a motor (not shown), an endless belt (also not shown) is stretched to drive both pulleys and thereby to drive the coin propelling belt 20. Then, when the cover 25 is opened, the driving pulley 50, together with the pulleys 46 and 47, is rotated about the rotatable shaft 24 as the center of rotation, and the distance from the pulley of the output shaft of the motor changes. However, since the driving pulley 50 is positioned near the axial line extended from the rotatable shaft 24, the tension of the belt is not substantially changed by the rotation of the pulley 50 and the belt is prevented from coming off the pulley by slip-off prevention means (not shown).

The operation of the coin delivering device of a coin processing machine according to this invention is as follows.

When coins are to be processed, the height of the thickness limiting member 18 of the cover 25 is first adjusted so as to set the member to the position suitable for the thickness of the coins of a kind to be processed. At the same time, the height of the coin propelling belt 20 is also adjusted to be suitable for the thickness of the coins to be processed. For this adjustment, the thickness setting knob 23 is rotated to a position corresponding to the coin to be processed. In accordance with the rotation of the knob 23, the disk cam 17 is also rotated, and the cam follower 15 is moved upwardly or downwardly. In conjunction with this movement, the support structure 13A is moved up and down, and the link 5A is also rotated, thereby to move links 8A and 8B longitudinally and rotate the other link 5B about the supporting arm 4B of the frame 3B.

Therefore, the support structure 13B is moved up and down in the same direction through the same stroke as in the case of the support structure 13A. In conformance with these stroke movements of the support structures 13A and 13B, the cover 25, which is mounted on the supports 13A and 13B, is also moved up and down, and, according to the movement of the cover 25, the distance between the thickness limit member 18 and the turntable 2 is adjusted so as to conform to the thickness of the coins C to be processed. The distance between the coin propelling belt 20 and the coin passage 21 can also be adjusted to suit the coins C.

If, during the up-and-down movement of the cover 25, there is an error in the vertical positions of the support structures 13A and 13B, there may be cases where the raising and lowering of the support structures 13A and 13B along a guide (not shown) become difficult for the reason that the cover 25 is supported by the structures 13A and 13B through the rotatable shaft 24. Furthermore, even if the raising and lowering of the structures are possible, there may be cases where the cover 25 cannot be maintained horizontal and the distance between the thickness limiting member 18 and the turntable 2 becomes uneven, whereby the limitation of the thickness of the coins to be processed cannot be properly performed. In order to overcome these difficulties, it is necessary to rotate the adjusting screw 9 positioned between the links 8A and 8B to adjust the combined length of the links 8A and 8B and also the relative vertical positions of the support structures 13A and 13B. Thus, the vertical positions thereof can be made to coincide.

When, after the setting of the thickness limiting member 18 and the coin propelling belt 20 to the positions suitable for the thickness of the coins C to be processed, the coins C are fed from a hopper or a belt conveyor (not shown) onto the rotating turntable 2, the coins C are urged by the centrifugal force of the turntable 2 towards the periphery thereof and against the vertical edge 28 of the thickness limiting member 18 so that only the coins having thicknesses less than the distance between the thickness limit part 29 of the member 18 and the turntable 2 are passed through the space therebetween and moved in the arrow direction in FIG. 1.

Then the coins C are delivered toward the inlet part of the coin passage 21 and then into the coin passage 21 successively by the guide roller 34, located near the inlet part, and are thereafter further delivered into the coin passage 21, having a width determined by rotating the setting knob 42, toward the star-wheels 37 by the driving of the coin propelling belt 20 as the height from the coin passage 21 and the thickness limiting member 18 are maintained so as to pass coins having thicknesses less than the predetermined thickness. Successively, the coins C being delivered by the belt 20 rotate the star-wheel 37, which thereby counts the coins. Finally, suitable processing, depending on the kind of coin processing machines, is carried out with respect to the coins emerging from the coin passage 21.

If, during the coin processing described above, a combination of two or more coins in stacked state or a coin having a thickness exceeding the predetermined thickness is caught between the thickness limit member 18 and the turntable 2 or between the coin propelling belt 20 and the coin passage 21, normal coin feeding operation is prevented, and therefore these coins must be removed.

This coin removal is carried out by rotating the lock knob 30 to release the projection 32 of the lock shaft 31 from the engagement piece 33, and then, since the cover 25 is merely pivoted rotatable the rotating shaft 24, it is easily rotated about the shaft 24 by merely lifting the side of the thickness limit member of the cover 25 and is restricted and maintained open at about 90°. Together with the rotation of the cover 25, the lock knob 30, the setting knob 42, and the pulleys 46 and 47 are also rotated about the rotatable shaft 24, and, therefore, the part in which the coins are jammed can be easily found and the coins removed. Furthermore, since the clutch member 45 of the clutch plate 44 is engaged with the pin 40 of the clutch plate 41, and since the rotation of the setting knob 42 is transmitted to the cam shaft 39, the rotation of the setting knob 42 in accordance with the opening of the cover 25 does not have a deleterious effect on the cam shaft 39.

After the removal of the jammed coins, when the cover 25 is again rotated to close it, the projection 27 of the cover 25 abuts against the upper surface of the support structure 13B, and then the cover 25 is moved into closed position. Rotation of the lock knob 30 thereafter causes the projection 32 to engage with the engagement piece 33 of the support structure 13A, and inadvertant opening of the cover 25 can thus be prevented. The coupling between the setting knob 42 and the cam shaft 39 can be made by merely engaging the clutch member 45 with the pin 40, and special means therefor is not needed. Furthermore, because the clutch member 45 is made of an elastic material, positive engagement of the clutch member 45 with the pin 40 is ensured even if the distance between the clutch plate 41 and the pin 40 is changed by the up and down movement of the cover 25.

The coin delivering device in a coin processing machine shown in FIG. 1 according to this invention has a cover mounted rotatably on the base, a thickness limiting member for coins to be processed, and coin delivering means supported by the cover, which are released all at once from the turntable and the coin passage by rotating the cover.

Therefore, even in the case where coins to be processed become jammed between the thickness limit member and the turntable or between the coin delivering means and the coin passage, and the portion in which the coins are jammed is not easily determined, this portion can be easily found by merely rotating the cover to open it, and the coin can be easily removed. Furthermore, the adjustment and the checking of the device can be easily carried out.

Figure 3:
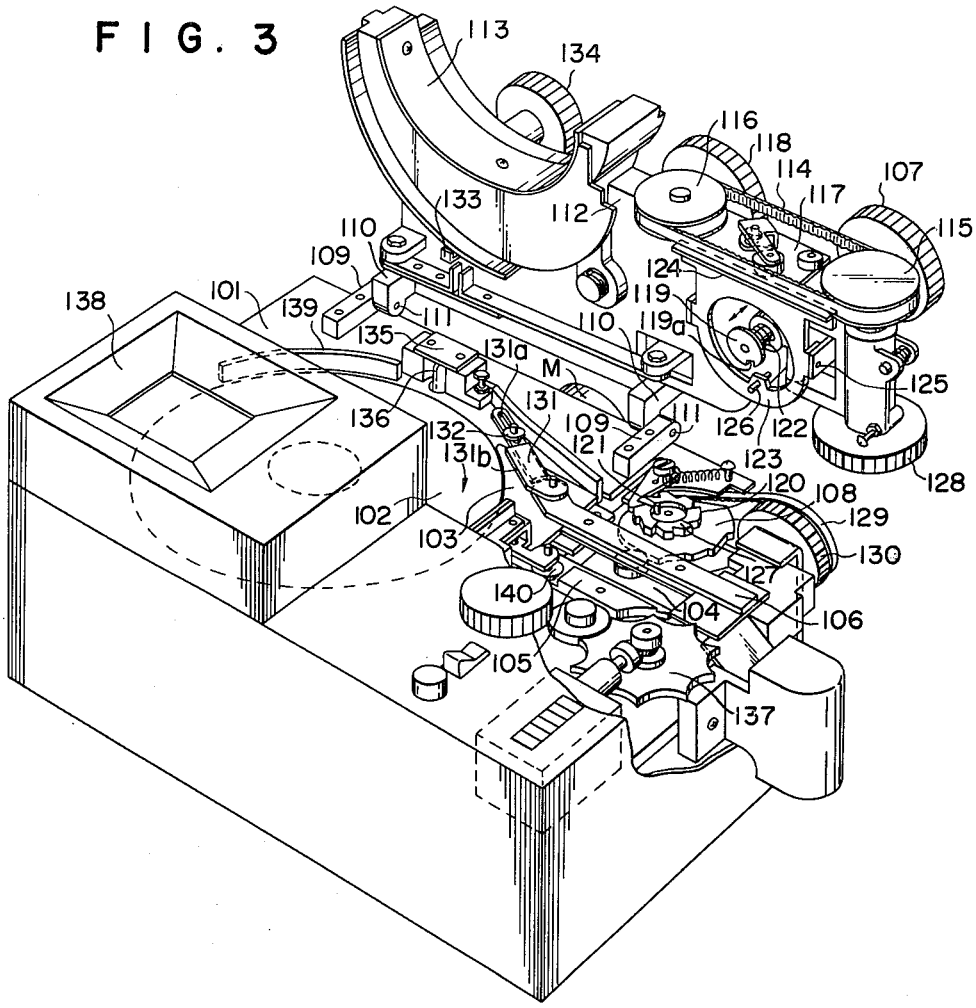
FIG. 3 is a perspective view, with parts cut away, showing another embodiment of this invention in which a cover has been removed.

FIG. 3 shows another example of a coin delivering device of a coin processing machine according to this invention in which the cover is fully opened. In this embodiment of the invention, a driving wheel and a follower wheel are used as a mechanism for driving a coin propelling belt in place of the pulley 50 connected to a motor by means of a belt (not shown) in FIG. 1. Furthermore, the thickness limiting member in this embodiment of the invention is so attached to the cover that it is movably up and down, whereas in the embodiment shown in FIG. 1, the thickness limiting member is formed integrally with the cover.

In the device illustrated in FIG. 3, a cover 112 is rotatably attached to one side of a base 101, whereby it can rotate, about a shaft 111 supported by bearing members 109 and 110, and is provided with a thickness limiting member 113 to permit coins to be processed having a thickness less than the predetermined thickness to pass through the space between this member 113 and the turntable 102 towards an inlet part 103 of a coin passage 104. On a part of the front side of the cover 112, there is provided a frame 117 which rotatably supports shafts of pulleys 115 and 116 for driving a coin propelling belt 114 disposed over and along the coin passage 104 when the cover 112 is closed, and the vertical positions of the thickness limiting member 112 and the frame 117 are adjustable in conformance with the thickness of the kind of coins to be processed by rotating a height adjusting knob 118.

A clutch mechanism for operatively connecting a knob 107, for setting to a selected kind of coin, to a cam 108, for limiting the width of the coin passage is constructed in a manner such that a cutout 119*a* provided on the outer periphery of a clutch plate 119, attached to an end of the shaft of the setting knob 107, is engageable with a pin 121 projecting on a ratchet gear 120 mounted on the upper surface of the cam 108 for permitting only one direction of rotation. The clutch plate 119 can be slightly retracted against the action of a spring 122.

A member 123 for limiting the height of the passage 104 is positioned along the travel side downstream of the belt 114 and is provided with a member 124 for limiting the thickness of a coin which is introduced into the coin passage 104. Both sides of the member 123 are supported rockably to the cover 112 by a shaft 125. When the cover 112 is closed, a projection 126 provided on the end opposite to the thickness limit member 124 is abutted against a cam 127 formed on the upper surface of the ratchet gear 120 so that the thickness limit member 124 may be positioned at a position corresponding to the thickness of the coin in the passage having the width determined by the rotational position of the cam 108.

Furthermore, in this embodiment shown in FIG. 3, a geared follower wheel 128 is fixed to a shaft coaxially with the pulley 115, and a geared driving wheel 130, which is driven through a belt 129 by a motor M is installed on one side of the base 101 and is engageable with the follower wheel 128 when the cover 112 is closed. The shaft of the driving wheel 130 is urged upwardly by a spring so as to ensure the absorption of the upward and downward displacement of the frame 117 according to the kind of the coin to be processed and also to ensure the engagement with the follower wheel 128.

A coin guide member 131 is pivotably attached to one end of a stepped movable side wall forming one part of the coin passage 104 and is provided with a slot 131*a* through which a pin 132 secured to the base 101 is inserted. The coin guide member 131 guides a coin to the inlet part 103 of the coin passage 104 in response to the movement of the movable side wall 106 of the coin passage 104. On the end of the member 131 near the turntable 102, there is formed an overhanging edge 131*b* to prevent coins from overriding onto the guide member 131.

A locking member 133 is engaged between a locking plate 135 and a pin 136 provided on the base 101 by rotating a locking knob 134 and to lock the cover 112 when the cover 112 is closed. Furthermore, there are provided a counting mechanism 137, such as a starwheel, for counting coins passing through the coin passage, a coin feeding hopper 138, a peripheral wall 139, and a frustoconical guide roller 140 near the coin inlet 103 of the coin passage and adapted to prevent the rising of the coin by a component of force to press downward the coin fed into the coin passage 104.

According to the construction of the coin delivering device according to this invention in use, when the cover 112 is closed, the follower wheel 128 on the cover 112 is engaged with the driving wheel 130 on the base 101, and the rotation of the driving wheel 130, driven by the motor M, is transmitted to the follower wheel 128, through which the driving force is transmitted to the coin propelling belt 114. When the cover 112 is to be closed, the locking knob 134 is rotated thereby to fit the locking member 133 between the locking plate 135 and the pin 136.

At this time, the thickness limiting member 113 is positioned above the turntable 102, and the clutch plate 119 is abutted against the pin 121 on the ratchet gear 120. By rotating the setting knob 107, the cutout 119*a* of the clutch plate 119 is engaged with the pin 121, and the relative position between the setting knob 107 and the cam 108 is determined. Furthermore, the projection 126 of the height limit member 123 abuts against the cam 127 on the upper surface of the ratchet gear 120, whereby the height limit member 124 is positioned above the coin passage 104 is alignment with the coin propelling belt 114. At the next step, by rotating the height adjustment knob 118 and the setting knob 107 respectively in conformance with the kind of coin to be processed, the positions of the thickness limit member 113, the belt 114, and the height limit member 124 are respectively determined through a trasmitting mechanism (not shown), and the width of the coin passage 104 is also determined by the movement of the movable passage member 106 in accordance with the rotation of the cam 108.

When the turntable 102 and the belt 114 are driven after the above described operations, coins fed from the hopper 138 onto the turntable 102 are forced by centrifugal force toward the periphery of the turntable 102 and arranged there in order. The coins are then delivered along the side surface of the coin guide member 131 toward the inlet part 103 of the coin passage 104 and introduced thereinto. In the passage 104, the coins are delivered toward the outlet part with the belt pressed forcibly against the coins.

During the coin delivering process, the coins are counted by the counting mechanism 137.

When exposure of the turntable 102, the coin passage 104, and the relative mechanism is needed, the exposure can be accomplished by rotating the locking knob 134, to disengage the locking member 133 from the locking plate 136, and lifting the cover 112 apart from the base 101 to open it.

The coin delivering device of the coin processing machine shown in FIG. 3 according to this invention provides not only the advantageous features mentioned in relation to the first embodiment of the invention shown in FIG. 1 but also other advantages. For example, since the means for transmitting driving force to the coin propelling belt is constituted by the driving wheel on the base and the follower wheel on the cover, no inordinate force will be applied to the means when the cover is opened or closed, and furthermore, the arrangement of components of the apparatus is extremely simple, the transmission of the driving force from the motor to the coin propelling belt is made positive.

In this embodiment, it is of course possible to utilize friction wheels to transmit the driving force in place of the geared driving wheel and the geared follower wheel.

I claim:

1. A coin delivering device for use in a coin processing machine comprising:

a base member;

a turntable rotatably supported on said base member and adapted to move coins to be processed towards the periphery of said turntable by centrifugal force;

means defining a coin passage communicating with said turntable periphery to receive coins discharged therefrom by centrifugal force;

limiting means positioned above said turntable periphery for setting the upper limit of the thickness of coins passing from said turntable periphery to said coin passage;

adjustment means for adjusting the distance between said limiting means and said turntable periphery in accordance with the thickness of coins to be processed by said device;

coin propelling means positioned above said coin passage for propelling coins along said coin passage;

cover means supporting said limiting means and said coin propelling means;

support means pivotally supporting said cover means on said base member for pivotal movement between a closed position, in which said limiting means and said coin propelling means overlie said turntable and said coin passage respectively, and an open position, in which said limiting means and said coin propelling means are separated from said turntable and said coin passage, said support means including adjustable link means for controlling the support of said cover to maintain the horizontal evenness of the distance between the lower surface of said limiting means and the upper surface of said turntable when said cover means is in the closed position.

2. A device according to claim 1 wherein said coin propelling means comprises an endless coin propelling belt and pulleys, the respective shafts of which are rotatably supported by the cover means, said coin propelling belt being stretched around said pulleys.

3. A device according to claim 2 wherein the shafts of said pulleys are rotatably supported by said cover means in a manner such that, when said cover means is in its closed position, said belt is positioned above the coin passage to press against and propel coins along the coin passage, said coin propelling means further comprising a follower wheel mounted on the shaft of one of said pulleys and a driving wheel provided on the base member so that, when said follower wheel is engaged with said driving wheel, driving force can be transmitted to said coin propelling belt through engagement between said two wheels.

4. In a coin delivering device adapted for use in a coin processing machine and including a base member, a turntable rotatably supported on said base member and adapted for moving coins to be processed towards the periphery of said turntable by centrifugal force, means defining a coin passage at said turntable periphery to receive coins ejected from said turntable by centrifugal force, and a cover, the improvement comprising:

a thickness limiting member supported by said cover;

support means pivotally connecting said cover to said base and permitting pivoting of said cover between a closed position, in which said thickness limiting member overlies said turntable periphery to set the upper limit of the thickness of coins passing from said turntable periphery to said coin passage, and an open position, in which said thickness limiting member is separated from said turntable periphery, said support means including adjustable link means for controlling the support of said cover to maintain the horizontal evenness of the distance between the lower surface of said thickness limiting member and the upper surface of said turntable when said cover is in the closed position; and coin propelling means for propelling coins in said coin passage toward a coin receiver, said coin propelling means coupled with said cover so as to separate said coin propelling means from said coin passage when said thickness limiting member is separated from said turntable by pivoting of said cover.

5. In a coin delivering device as claimed in claim 4, the further improvement comprising cam means cooperating with said support means for adjusting the distance between said thickness limiting member and said turntable when said cover is in the closed position in accordance with the maximum thickness of coins to be processed by said device; and control means for controlling said cam means position relative to said support means.

6. In a coin delivering device as claimed in claim 4, the further improvement comprising support members pivotally supporting said cover on said base and coupling said link means with said cover so that said thickness limiting member is supported so as to be separable from said turntable by pivoting of said cover.

7. In a coin delivering device as claimed in claim 4, the further improvement in which said coin propelling means comprises pulleys and an endless coin propelling belt stretched around said pulleys, respective shafts of said pulleys being rotatably supported by said cover.

8. In a coin delivering device as claimed in claim 7, the further improvement in which the shafts of said pulleys are rotatably supported by said cover in a manner such that, when the cover is in its closed position, said coin propelling belt is positioned above the coin passage to press against and propel coins along the coin passage, and in which said coin propelling means further comprises a follower wheel mounted on the shaft of one of said pulleys and a driving wheel mounted on said base member so that, when said follower wheel is engaged with said driving wheel, driving force is transmitted to said coin propelling belt through engagement between said two wheels.

* * * * *